US011674342B2

(12) United States Patent
Riel

(10) Patent No.: US 11,674,342 B2
(45) Date of Patent: Jun. 13, 2023

(54) DOOR SILENCING MECHANISM SYSTEM AND ASSOCIATED METHODS

(71) Applicant: Daniel Joseph Riel, Encinitas, CA (US)

(72) Inventor: Daniel Joseph Riel, Encinitas, CA (US)

( * ) Notice: Subject to any disclaimer, the term of this patent is extended or adjusted under 35 U.S.C. 154(b) by 373 days.

(21) Appl. No.: 16/817,204

(22) Filed: Mar. 12, 2020

(65) Prior Publication Data

US 2020/0347652 A1 Nov. 5, 2020

Related U.S. Application Data

(60) Provisional application No. 62/842,541, filed on May 3, 2019.

(51) Int. Cl.

| | |
|---|---|
| ***E05C 1/08*** | (2006.01) |
| ***E05C 1/00*** | (2006.01) |
| ***E05B 63/20*** | (2006.01) |

(52) U.S. Cl.

CPC ..... *E05C 1/08* (2013.01); *E05B 63/20* (2013.01); *E05C 1/002* (2013.01); *E05Y 2201/474* (2013.01); *E05Y 2800/10* (2013.01)

(58) Field of Classification Search

CPC .... E05B 17/0045; E05B 17/005; E05B 63/18; E05B 63/185; E05B 63/20; E05B 2063/207; E05B 65/1013; Y10T 292/54; Y10T 292/558

See application file for complete search history.

(56) References Cited

U.S. PATENT DOCUMENTS

| | | | | | |
|---|---|---|---|---|---|
| 3,993,335 | A * | 11/1976 | Schmidt | E05B 65/1066 | 292/336.3 |
| 5,531,492 | A * | 7/1996 | Raskevicius | E05B 63/20 | 292/335 |
| 6,045,169 | A * | 4/2000 | Frolov | E05B 63/202 | 292/335 |
| 6,082,790 | A * | 7/2000 | Mossotti | E05B 17/005 | 292/289 |
| 2018/0016824 | A1* | 1/2018 | Durrant | E05B 17/005 | |

FOREIGN PATENT DOCUMENTS

| | | | | |
|---|---|---|---|---|
| DE | 10003393 | A1 * | 8/2000 | E05B 13/00 |

OTHER PUBLICATIONS

Machine Translation for DE10003393 (Year: 2000).*

* cited by examiner

*Primary Examiner* — Christine M Mills
*Assistant Examiner* — Christopher F Callahan

(57) ABSTRACT

A door silencing mechanism and methods to eliminate latch noise associated with a door latch having a spring latch bolt and a bolt housing are described. This mechanism and methods can include an actuator having a first end and a second end and moveable between a first position and a second position. This mechanism can also include a device coupled to the first end of the actuator to maintain the spring latch bolt within a bolt housing using the second end of the actuator when the device holds the actuator in the first position and to release the spring latch bolt from within the bolt housing by moving the second end of the actuator in response to the actuator moving to the second position in response to contact with a doorjamb.

23 Claims, 8 Drawing Sheets

DOOR SILENCING MECHANISM SYSTEM AND ASSOCIATED METHODS

PRIORITY

This application claims the benefit of the filing date of U.S. provisional patent application No. 62/842,541, filed May 3, 2019 and entitled Door spring latch silencing attachment device and method for quieting latch noise by managing a spring latch bolt, and this provisional patent application is hereby incorporated herein by reference.

FIELD OF INVENTION

The present disclosure relates generally to the field of a door latch silencer. More specifically, the present disclosure relates to a mechanism and its associated methods for eliminating latch noise associated with a door latch.

BACKGROUND

A traditional door latch produces noise when the latch "pops" out after passing beyond a latch hole on a door jamb. The door also makes a noise when the latch hits the strike plate. Additionally, the spring latch bolt keeping constant force against the strike plate accelerates the door movement at the final moment of closure as the latch passes beyond the curved tab of the latch hole. As a result, this increases the door contact noise with the jamb. Further, a spring latch bolt can be disturbing on its own although the door to the door jamb contact noise has been eliminated.

Thus, Applicant has recognized that there is a need for a mechanism and related methods which may be used to eliminate latch noise associated with a door latch having a spring latch bolt and a bolt housing.

SUMMARY OF THE DESCRIPTION

A door silencing mechanism and associated methods are described. The mechanism and the associated methods, once implemented, can eliminate latch noise associated with a door latch having a spring latch bolt and a bolt housing.

A mechanism according to one embodiment described herein can include an actuator having a first end and a second end. The actuator can be moveable between a first position and a second position. The mechanism can also include a device coupled to the first end of the actuator to maintain the spring latch bolt within a bolt housing using the second end of the actuator when the device holds the actuator is in the first position and to release the spring latch bolt from within the bolt housing by moving the second end of the actuator in response to the actuator moving to the second position in response to contact with a door jamb In one embodiment, when the actuator is in the second position, the spring latch bolt can be aligned with a bolt retainer and be allowed to be received by the bolt retainer positioned at a door jamb main body.

According to an embodiment of the present disclosure, the device can include a spring. The device can further include a contact component to cause the spring latch bolt to be released from within the bolt housing in response to contact with the doorjamb.

In another embodiment, the first end of the actuator is coupled to an extension component to extend a contact point associated with the first end, such that the extended contact point makes contact with the door jamb during a door closure.

In another embodiment, the first end of the actuator can be coupled to an extension component to maintain the actuator in the first position. The extension component can cause the second end of the actuator to move to the second position and to release the spring latch bolt from within the bolt housing in response to contact with the doorjamb.

In one embodiment, the extension component can include a door status indicator indicating the spring latch bolt has been received by the bolt retainer.

According to an embodiment of the present disclosure, the device can further include a stopping component being positioned on a backing plate of the door latch to maintain the actuator in the first position. The device can also include an attachment component being positioned on the backing plate of the door latch to secure the actuator to the backing plate of the door latch.

In another embodiment, the actuator can have an S shape. The second end of the actuator can be maintained in the first position by an elastic component.

In one embodiment, the actuator can have a shape and can be dimensioned to fit a space between the door latch and the door jamb. The second end of the actuator can be maintained in the first position to contact a top portion and a bottom portion of the spring latch bolt.

A method according to one embodiment described herein can include maintaining the spring latch bolt within the bolt housing using a second end of an actuator when the actuator is in a first position, moving the actuator into a second position in response to the actuator contacting a door jamb, and releasing the spring latch bolt from within the bolt housing by moving the second end of the actuator in response to the actuator moving to the second position.

In one embodiment, the spring latch bolt can be released when the spring latch bolt passes beyond a bolt retainer associated with the doorjamb.

In another embodiment, the method can further include releasing the spring latch bolt from within the bolt housing in response to a contact component contacting the doorjamb.

In one embodiment, the method can also include moving the second end of the actuator to the second position to release the spring latch bolt from within the housing in response to an extension component coupled to the first end of the actuator contacting with the door jamb, such that the spring latch bolt is positioned behind a tab edge associated with the strike plate. In another embodiment, the extension component can include a door status indicator indicating the spring latch bolt has been received by the bolt retainer.

A door silencing mechanism to eliminate latch noise associated with a door latch having a spring latch bolt and a bolt housing according to one embodiment described herein can include a sliding component. In one embodiment, the door silencing mechanism can be coupled to a backing plate to guide the sliding component to move from a first position to a second position, the sliding component to maintain the spring latch bolt within the bolt housing when the sliding component is in the first position and to release the spring latch bolt from within the bolt housing when the sliding component is in the second position in response to contact with a door jamb.

In one embodiment, the spring latch bolt surface includes a groove to guide the spring latch bolt from the first position to the second position.

In one embodiment, the sliding component having a protrusion that acts to hold the spring latch bolt within the bolt housing when the sliding component is in the first position and extends into the groove of the spring latch bolt as the spring latch bolt is released when the sliding component is being moved from the first position to the second position.

In one embodiment the backing plate includes a slot to stop the sliding component when the sliding component is in the second position in response to contact with the doorjamb.

In one embodiment, the door silencing mechanism further includes one or more compression springs coupled to the sliding component to maintain the sliding component in the first position when the sliding component is not in contact with the doorjamb.

In one embodiment, the sliding component includes an opening.

The above summary does not include an exhaustive list of all embodiments in this disclosure. All systems and methods can be practiced from all suitable combinations of the various aspects and embodiments summarized above, and also those disclosed in the Detailed Description below.

BRIEF DESCRIPTION OF THE DRAWINGS

The present invention is illustrated by way of example and not by limitation in the figures of the accompanying drawings in which like references indicate similar elements.

DETAILED DESCRIPTION

Figure 1A:
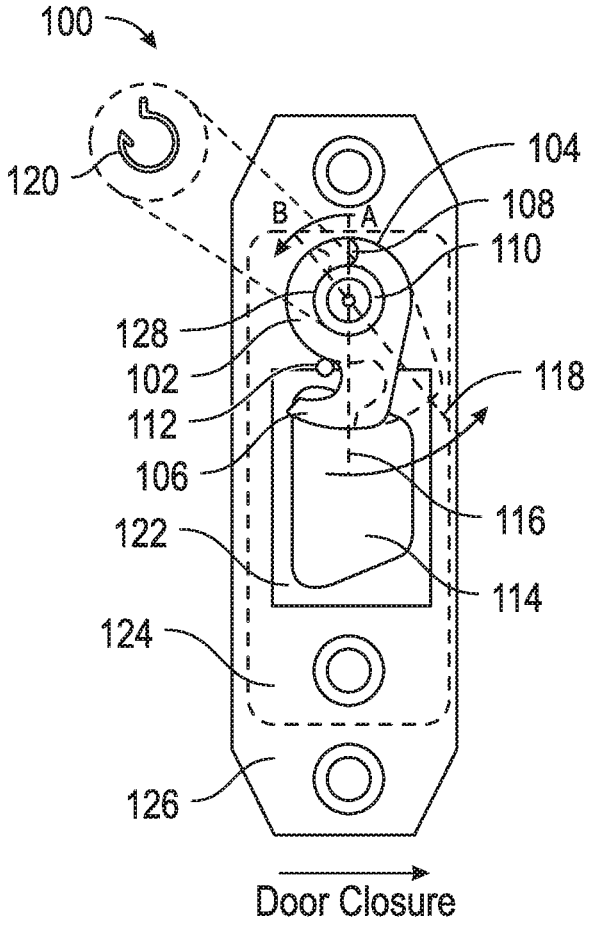
FIG. 1A is a front elevation view of an example of an actuator and a device in use, according to an embodiment.

Various embodiments and aspects will be described with reference to details discussed below, and the accompanying drawings will illustrate the various embodiments. The following description and drawings are illustrative and are not to be construed as limiting. Numerous specific details are described to provide a thorough understanding of various embodiments. However, in certain instances, well-known or conventional details are not described in order to provide a concise discussion of embodiments.

Reference in the specification to "one embodiment" or "an embodiment" means that a particular feature, structure, or characteristic described in conjunction with the embodiment can be included in at least one embodiment. The appearances of the phrase "in one embodiment" in various places in the specification do not necessarily all refer to the same embodiment. Although the processes are described below in terms of some sequential operations, it should be appreciated that some of the operations described may be performed in a different order. Moreover, some operations may be performed in parallel rather than sequentially.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment," "an embodiment," "certain embodiments," or "other embodiments" of the present disclosure are not intended to be interpreted as excluding the existence of additional embodiments that also incorporate the recited features. Furthermore, reference to terms such as "above," "below," "upper," "lower," "side," "front," "back," or other terms regarding orientation are made with reference to the illustrated embodiments and are not intended to be limiting or exclude other orientations.

The embodiments described herein allow latch noise associated with a door latch having a spring latch bolt and a bolt housing to be eliminated.

Embodiments of the door silencing mechanism and method silences or reduces the door latch noise by controlling the movement of a spring latch bolt associated with a door in order to limit hardware contact. The mechanism allows the spring latch bolt to remain below the door surface and within the latch assembly until the moment the door is fully, or near fully shut, thereby eliminating the immediate contact between the spring latch bolt[AA1] and strike plate or other latch retaining hardware. Embodiments of the door silencing mechanism and method also restricts the bolt from sudden, unimpeded spring extension which occurs when a spring latch bolt passes beyond the tab of the latch opening or a bolt retainer at the final moment of a door closure. The mechanism restricts the spring latch bolt to a gradual extension using the force of the closing door to turn the restricting element of the mechanism, thereby eliminating the typical "popping" sound heard at the final moment of door closure.

A standard door spring latch, or dead latch management device and method reduce or eliminate latch noise through a mechanical actuator, or a multitude of actuators which work to manage a door latch bolt.

This is opposite to the traditional means of door latching where a spring latch bolt being extended from its assembly housing by a compression spring as its default position is pushed into its assembly housing during door closure when its curved edge slaps against a strike plate or jamb just before springing to immediate, full extension when the bolt passes beyond the sheer edge or tab of its corresponding latch opening or a bolt retainer. These traditional workings of a latch are forceful and immediate in the retracting and extending of the latch bolt which involve a rapid contact of hardware and unimpeded spring extension to an immediate stop point. These actions create unwanted noise which can be disturbing. In contrast, in the embodiment of mechanism and method described herein, the spring latch bolt would be held low with respect to the latch plate surface and this position represents a default position for the spring latch bolt. The default position creates a clearance between the spring latch bolt and the passing surface of the strike plate or alternate latching surface until a switch or a lever, herein referred to as an actuator, is employed to activate the spring latch bolt to be released in a controlled motion at a precise moment when the tip of the spring latch bolt is positioned just over the latch opening, a bolt retainer or an alternate latch bolt mate while allowing for the hardware originally intended full ability to latch and lock.

Figure 1B:
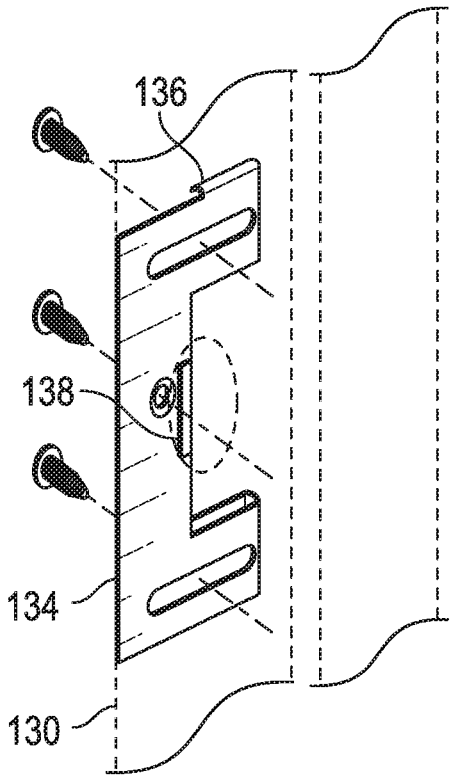
FIG. 1B is a perspective view of a door strike plate and a door jamb part, according to an embodiment.

The present disclosure is directed to door silencing mechanism 100, for example as illustrated in FIGS. 1A and 1B. The door silencing mechanism 100 includes an actuator 102 and a device 128, according to an embodiment. In one embodiment, the actuator 102, for example, includes a first end 104 and a second end 106 and is moveable between a first position 116 and a second position 118. As further illustrated in the embodiment of FIGS. 1A and 1B, the device 128 is coupled to the first end 104 of the actuator 102 to maintain the spring latch bolt 114 within a bolt housing 122 using the second end 106 of the actuator 102 when the device 128 holds the actuator 102 is in the first position 116 and to release the spring latch bolt 114 from within the bolt housing 122 by moving the second end 106 of the actuator 102 in response to the actuator 102 moving to the second position 118 in response to contact with a door jamb 130.

In one embodiment, the spring latch bolt is released from within the bolt housing by moving the second end of the actuator in response to the actuator moving to the second position in response to contact between a contact point 108 and a raised portion 136 associated with the door jamb.

In one embodiment, the actuator 102 or the control lever keeps the spring latch bolt 114 within its assembly bolt housing 122, such that the spring latch bolt 114 is held low with respect to the perpendicular latch plate surface from which the spring latch bolt 114 protrudes. This position where the spring latch bolt 114 is held low with respect to the perpendicular latch plate surface becomes the spring latch bolt default position (first position 116), thereby preventing the spring latch bolt 114 from extending outwardly (latched position) until the spring latch bolt 114 is aligned with its mating latch opening or bolt retainer 138, during which the spring latch bolt 114 is released in a controlled motion into the latch opening, bolt retainer or behind the tab or alternate latch retaining element.

In one embodiment, the spring latch bolt 114 would be held within its assembly bolt housing 122 as its resting default position until an actuator 102 or a contact lever built into the latch hardware would trigger the outward movement of the spring latch bolt 114. This embodiment could be done in such a way that the standard door handle hardware could be compatible and pull the latch back into its housing when the door user turns the door handle.

In one embodiment, the actuator 102 can include a spring latch bolt retaining end 106 and a contact end 104 for the input of force against the door jamb stop or other hardware mounted on the door jamb. The actuator 102 is attached to a mounting surface or a backing plate 126 by way of a hinge which could be a type of a rivet or a raised flange which the latch plate mounting screw could pass which keeps the lever close to the backing plate surface while allowing the actuator 102 to pivot upon.

In some embodiments, one end 106 of the actuator 102 covers and controls the motion of the spring latch bolt 114 by way of a movement across the curved surface of the bolt 114. Due to the curvature on a spring latch bolt 114 and the constant outward tension placed upon the latch bolt by the compression spring behind it, every degree that the actuator 102 is moved in the direction of the jamb door stop moves the latch contacting point of the actuator 102 to a lower point of the dead latch bolt 114 which extends the latch further out of its assembly bolt housing 122 with every degree of lever movement.

The actuator 102 can be a slim lever which pivots about an attachment point on a backing plate 126. The bolt retaining end 106 of the actuator 102 slides over and retains the latch bolt 114 within the latch assembly 122 in the door when the door user turns the door lever or the knob to pull the latch bolt 114 into its housing assembly 122 releasing it from behind its catch to open a door.

In some embodiments, the actuator 102 gradually releases the spring latch bolt 114 at the point of, or just before a contact between the door and the door jamb 130.

In various embodiments, the actuator 102 releases the bolt 114 when the contact component 108 makes contact with a raised portion in the jamb area. This contact pushes the second end 106 from the first position 116 to the second position 118 causing the bolt 114 to extend and rest behind the hole or behind an alternate latch mate surface so the door cannot be opened until the door user turns the door handle to reset the mechanism. In this embodiment, the strike plate or alternative and the latch plate need to have a specific gap, which could be very little and could be achieved by using spacers beneath the adjustable strike plate or beneath the backing plate 126.

As further illustrated in FIGS. 1A and 1B, in one embodiment, when the actuator 102 is in the second position 118, the spring latch bolt 114 is aligned with a bolt retainer 138 and allowed to be received by a bolt retainer 138 positioned at a door jamb 130.

Figure 4:
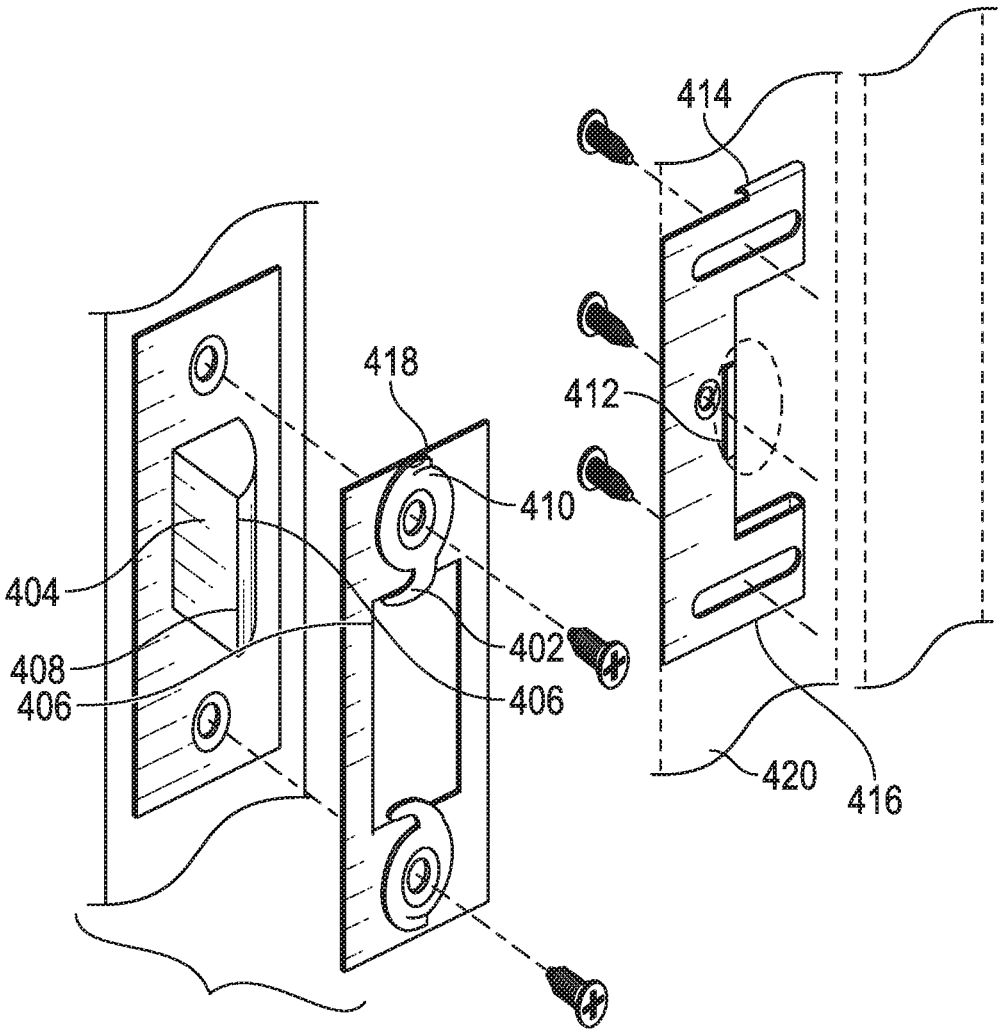
FIG. 4 is a perspective view of another example of a door silencing mechanism in use, according to an embodiment.

In various embodiments, the actuator 102 can be selected from any type of actuator as will be readily understood by one having ordinary skill in the art. The actuator 102 can be positioned either above or below the spring latch bolt 114. In one embodiment, the actuator 410 can operate in pairs such that the actuator 410 can be positioned above and below the spring latch bolt 404, as illustrated in FIG. 4. In one embodiment, the actuator 102 is positioned just above or below the latch bolt 114. In some embodiments, the latch plate screws may be positioned where the travel or the mounting of the actuator needs 102 to be. In one embodiment, the actuator hinge or the fulcrum may be right at the screw.

In some embodiments, the actuator 102 turns around a hinge or a flange. The motion of the actuator 102 is stopped at a point where the actuator 102 is just over the tip of the spring latch bolt 114 by a stopper 112 which is a raised portion or an addition to the backing plate surface on which the actuator 102 rests upon.

In addition, in various embodiments, the device is coupled to the first end 104 of the actuator 102 by any means understood and utilized in the art, such as by a threaded or snap connection, among others, as will be readily understood by one having ordinary skill in the art.

In one embodiment, the device 128 includes a spring 120. The spring 120 can be selected from any type of spring as will be readily understood by one having ordinary skill in the art.

Returning to FIGS. 1A and 1B, in one embodiment, the device 128 includes a contact component 108 to cause the spring latch bolt 114 to be released from within the bolt housing 122 in response to contact with the door jamb 130. In one embodiment, the spring latch bolt is released when the contact component makes contact with a raised portion 136 in the door jamb 130 as illustrated in FIG. 1B. The raised portion 136 is a component of an alternative strike plate which may or may not be made to be adjustable in its horizontal positioning on the door jamb 134.

Figure 2A:
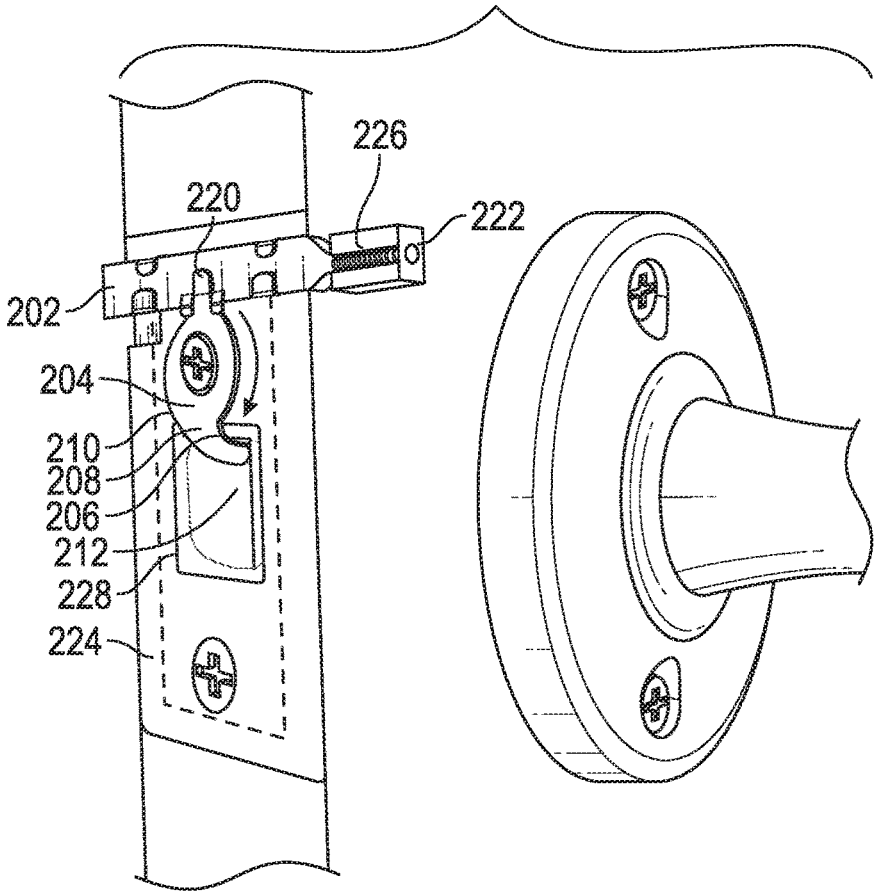
FIG. 2A is a perspective view of another example of an actuator and a device in use, according to an embodiment.

In one embodiment, FIG. 2A illustrates the first end 220 of the actuator 204 is coupled to an extension component 202 to extend a contact point associated with the first end 220, such that the extended contact point makes contact with the door jamb 216 during a door closure.

Figure 2B:
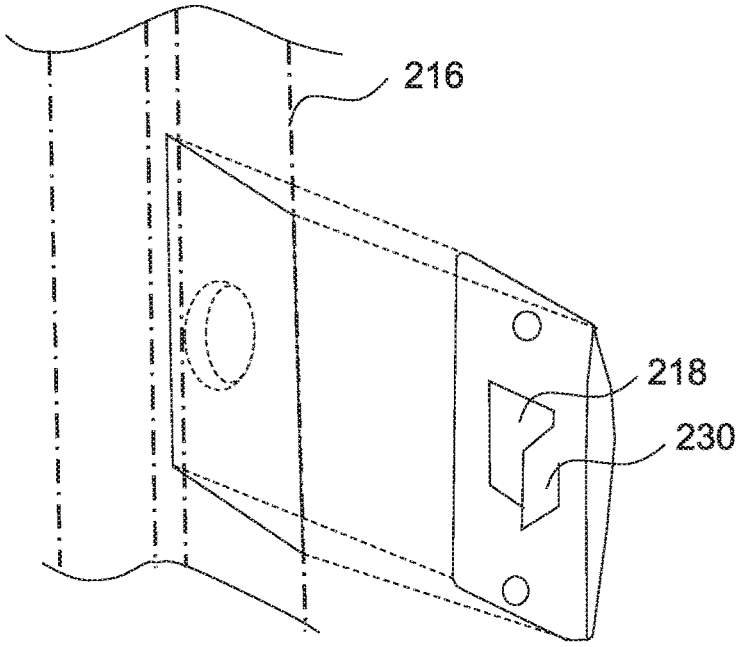
FIG. 2B is a perspective view of a door strike plate and a door jamb part, according to an embodiment.

As illustrated in FIGS. 2A and 2B, the first end 220 of the actuator 204 is coupled to an extension component 202 to maintain the actuator 204 in the first position 206, and the extension component 202 causes the second end 208 of the actuator 204 to move to the second position 210 and to release the spring latch bolt 212 from within the bolt housing 228 in response to contact with the door jamb 216.

In one embodiment, the extension component is in contact with an elastic component to maintain the actuator in the first position.

In one embodiment, the embodiment of the mechanism can be mounted over a door latch plate 224 using holes countersunk.

In one embodiment, the extension component 202, for example, acts as an extension "arm" that can extend the contact point of the actuator 204 past the door's edge so as to make contact with the door jamb 216. The extension component 202 can make contact with the door jamb 216 and use the force of the movement of the door to push the actuator 204 on the spring latch bolt 212, thereby retaining the end of the lever in the direction of the slope of the latch bolt 212 sliding the actuator 204 off of the latch bolt 212.

As further illustrated in FIGS. 2A and 2B, the extension component 202 can include a door status indicator 222 indicating the spring latch bolt 212 has been received by the bolt retainer 218. The door status indicator 222 can also indicate the door has been fully latched.

In one embodiment, as illustrated in FIG. 1A, the device 128 can further include a stopping component 112 being positioned on a backing plate 126 of the door latch to maintain the actuator 102 in the first position 116. In one embodiment, the backing plate 126 of the door latch can be mounted over a door latch plate 124 and spring latch bolt 114 using two holes countersunk. These countersunk portions of these holes may be raised slightly above the backing plate 126 and can flange out in a circular shape to act as an attachment component that can keep the spring 120 connected to both the backing plate 126 and the actuator 102. The spring 120 keeps a constant pressure on the actuator 102 so the actuator 102 is set to a first position 116 or a default position.

In one embodiment, the backing plate 126 may use raised portions to stop the actuator 102 at a position that allows for the actuator 102 to be just over the tip of the spring latch bolt 114 when the actuator 102 is in resting position.

One end 104 of the actuator 102, being the contact end for input of force, moves the actuator 102 with the movement and force of the closing door. The other end 106 of the actuator 102 is the latch retainer, which restricts or covers and releases or uncovers the door spring latch bolt 114.

In some embodiments, the bolt retainer end 106 of the actuator 102 (which would likely be the longer end, in order to get more movement of the retainer with less movement or door-travel on the contact end) covers the door spring latch bolt 114 when the actuator 102 is its default position or first position 116. This restricts the spring latch bolt 114 inside of its housing assembly 122 within the door until the time the door is closed to the degree that the tip of the latch bolt 114 passes the tab on the opposing door jamb surface (a strike plate hole 218 or other latch retaining catch device). This means there is no contact between the latch bolt 114 and the strike plate during the door closure, thereby eliminating the initial contact noise created when the standard latch bolt would typically slap against the metal strike plate during the door closure.

In one embodiment, the end 104 of the actuator 102 that is opposite to the bolt retainer end 106, likely being a shorter extension from the fulcrum than that of bolt retainer end 106 of the actuator 102, is referred to as the lever contact. The lever contact is the point from which contact with stationary hardware on the opposite plane, being the door jamb, such as a protrusion on the strike plate pushes against the actuator with the force of the closing door forcing the catch or bolt retainer 138 opposite the fulcrum of the lever contact to slide off of the latch bolt 114 in a controlled motion.

In some embodiments, motion and anti-slip control of the actuator 102 being pushed away from the tip of the spring latch bolt 114 and down the curved surface of the spring latch bolt 114 when engaged by the alternate surface is maintained by way of constant tension pushing or pulling the actuator 102 towards its first position over the latch bolt 114.

In one embodiment, the force against the actuator 102 is achieved by either a spring 120 attached to the actuator 102 and backing plate 126 or linkage attached to the actuator 102 to have a spring housing in alternate location (such as on the door face) or a rubber band working in a similar fashion. This constant pressure pushing (or pulling) the bolt latch retainer end 106 towards its default latch restricting position or first position 116 means that when the lever retainer end 106 is pushed away from the latch bolt 114 at the moment of closure, the spring loaded latch bolt 114 will not fling the lever retainer end 106 aside unopposed when the lever retainer end 106 moves past the flat tip of the latch bolt 114 and onto the sloped edge of the latch bolt 114. This constant force towards the latch retaining position or first position 116 is also what allows for the automatic reset of the device when the latch bolt 114 is retracted by the turning of the door handle.

In one embodiment, the lever extension arm transfers force to the actuator 102 at its contact point 108 via a linkage connection 508. The actuator 102 moves in either direction with the movement of the extension arm and the spring is compressed and the actuator 102 is pushed over and down the curved surface of the spring latch bolt 114 extending the latch bolt 114 to its outward latched position only when there is pressure of the extension arm against the door jamb stop. Although there is no need for an additional raised contact point, this embodiment works with an adjustable strike plate 416, but would not have need for the raised portion 414.

In some embodiments, when a door user turns the door lever or the knob to open the door, the latch bolt 114 is pulled back into its housing 122 within the door and below the surface of the retaining lever allowing the actuator 102 to pivot on its fulcrum with the force of the spring or band pushing or pulling the retaining lever end 106 over the latch bolt 114, holding the latch bolt 114 inside of its housing assembly 122 within the door, only to be extended again when the door is fully shut.

In one embodiment, the retaining lever end 106 of the actuator 102 can be specially shaped with a chamfered edge and or curved, "fin" type shape, or S shape, which allows for the actuator 102 to slide more easily on and off of the latch bolt 114 own curved edge but also not have the ability to push the bolt 114 back into its housing assembly 122, both because of the steepness of the curve of the latch bolt 114 and the lack of strength in the spring or band pushing or pulling to the default position.

In various embodiments, the only time that the door latch 114 is extended is when the door is fully closed and the latch bolt 114 is past its catch (be it a traditional strike plate hole "tab" or other ledge provided by alternate hardware) so that that door cannot be opened without traditional means of turning the door knob or the handle.

In one embodiment, the mechanism allows for a proper alignment of the latch bolt 114 and opposite latch opening or bolt retainer 218 or bolt catch by way of an adjustable device in place of the standard strike plate. This strike plate alternative can be as simple as a vertical bar that mounts in place of the traditional strike plate having horizontal countersunk (chamfered) slots, rather than standard countersunk round screw holes and one or more countersunk screw holes for a set screw(s) to fix the plate into position once adjusted for proper latching.

In some embodiments, the slots allow for the device to be adjusted forward and backward on a horizontal plane further or closer to the door stop on the jamb. The catch point where the door latch bolt rests behind once extended and in the latched position could be moved up slightly higher than the rest of the bar which sits flush with the jamb. This raised "lip" would ensure that the latch bolt tip could not run backwards after extended behind the lip when the door is shut. Additionally, the latch retainer, be it the traditional sunken tab or the aforementioned raised lip or other catch point, could be made of or contain a coating which further reduces noise, such as rubber. This alternative plate's adjustable position could allow for an ideal positioning of the latch even when additional door silencing mechanism are installed on the door or jamb which change the positioning of the door latch when the door is fully shut such as door dampers i.e. self-adhesive felt or rubber pads. The door dampers which could be added to the jamb stop or door, not only quiet the door to jamb contact noise but also change the door gap when closed and therefore where the latch catch bar needs to be positioned to have the device function properly.

In one embodiment, the plate position can be aligned and fixed in place by a slim backing plate that has a surface with the inverse of the back of the latch bolt catch plate, such as a saw tooth shape. In such manner, when the plate screws are tightened, the plate is aligned vertically and cannot slip with force of the door being pulled after shut.

In some embodiment, another way to achieve a locked position of the adjusted catch plate is to have an additional countersunk screw hole or holes that could take a set of screws and work with adjustable horizontal slots, so that once the proper horizontal distance is found for a proper latching, a set of screws can be installed so that the plate cannot move.

In various embodiments, a spring or rubber band is employed to keep a constant pressure against the actuator 102 towards the first position 116 or reset position in order to provide a controlled movement, avoid a slippage, a means to reset the actuator 102 to its default position. This causes the actuator 102 to cover and retain the latch bolt 114 in its assembly housing 122 any time the door is not fully closed to the degree that the latch bolt 114 is over its latch opening or bolt retainer 218 or past the lip of an alternative mating hardware.

In some embodiment, the actuator 102 is reset when the door is opened by traditional means. When the handle is turned and the latch bolt 114 is drawn into its assembly housing 122, the tip of the bolt 114 drops below the surface of the actuator, at which point the bolt 114 is automatically covered by the lever 102 by way of the force of the spring or band. Once the handle is released, the spring-loaded latch bolt 114 cannot extend being that it is below the perpendicular surface of the actuator.

In various embodiments, the movement of the bolt retainer end 106 is controlled from being thrown immediately aside by the force of the extending spring loaded latch bolt 114 by way of a spring or band which keeps back pressure against the bolt retainer lever. This is important because of the curvature of the bolt 114 that the retainer slides against coupled with the force of the bolt 114 would allow the bolt 114 to spring out too quickly without the pressure back against the retainer. This tension back against the actuator 102 allows the retainer lever end 106 to only turn as quickly as the door closure allows and even a quick door closure does not produce the popping noise like that of a freely extending latch bolt without such a latch bolt control device.

As further illustrated in FIG. 1A, the device 128 further includes an attachment component 110 being positioned on the backing plate 126 of the door latch to secure the actuator 102 to the backing plate 126 of the door latch.

In one embodiment, the attachment component 110 is positioned on the backing plate 126 of the door latch to secure the actuator 102 to the backing plate 126 of the door latch with an adequate gap to allow for pivoting of the actuator 102. The attachment component 110 can be a flange, a screw, or a rivet type, as will be readily understood by one having ordinary skill in the art.

As illustrated in FIG. 4, in one embodiment, the actuator has an S shape.

Figure 3:
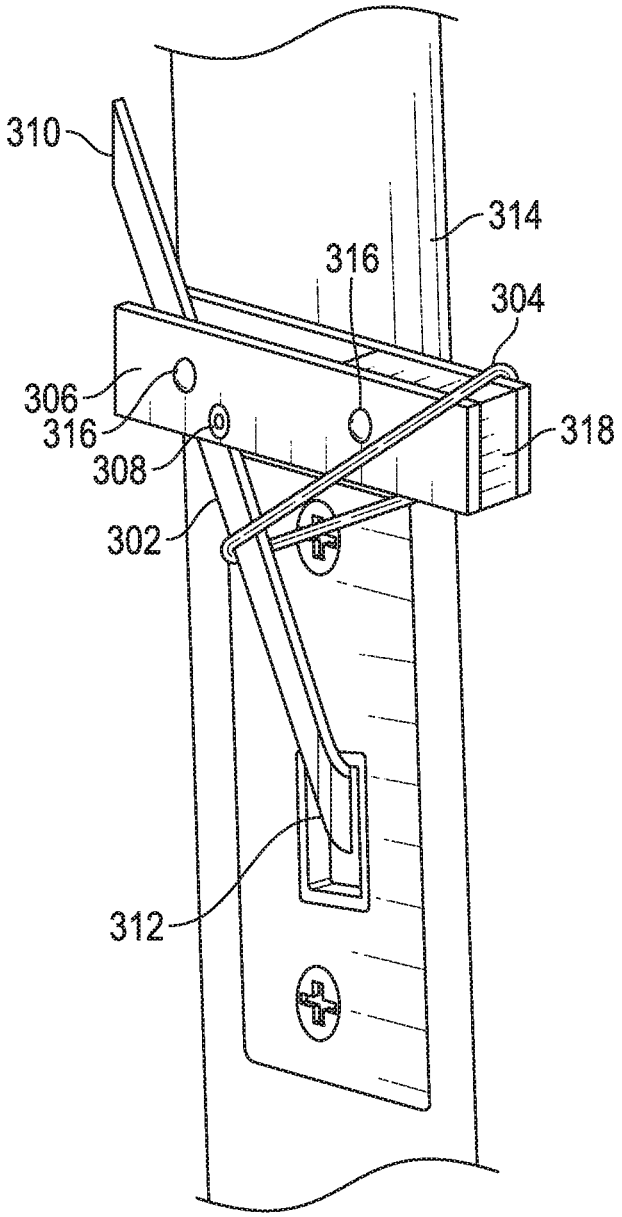
FIG. 3 is a perspective view of an example of a door silencing mechanism in use, according to an embodiment.

In one embodiment, the actuator 302 can be made from wood, popsicle sticks, or a plastic, as illustrated in FIG. 3. In one embodiment, fastening components 306, such as, for example, but not limited to, picture frame nails, are used to mount the actuator 302 to the door 314. In one embodiment, the fastening components 306 are used as an attachment component or a stopping mechanism 308 for the actuator 302. In one embodiment, the actuator 302 includes a first end 310 that can move the second end 312 of the actuator 302 to a second position in response to contact with the door jamb.

As further illustrated in FIG. 3, the second end of the actuator 302 is maintained in the first position by an elastic component 304. The elastic component 304 can be a rubber band, or a hair tie. The actuator 302 can have a shape and can be dimensioned to fit a space between the door latch and the door jamb.

In one embodiment, a mounting nail 316 is positioned to the left of a stopping mechanism 308 to act as an actuator hinge. The mounting nail 316 to the right of a stopping mechanism 308 is positioned to holds a spacer 318 in place.

Returning to FIG. 4, the second end of the actuator 402 is maintained in the first position to contact a top portion 406 and a bottom portion 408 of the spring latch bolt 404. The spring latch bolt 404 is released when the contact component 418 makes contact with a raised portion 414 in the door jamb 420 as illustrated in FIG. 4. The raised portion 414 is a component of an adjustable strike plate 416. In some embodiments, for example, when the actuator 402 is in the second position, the spring latch bolt 404 is allowed to be received by a bolt retainer 412 positioned at a door jamb 420.

Figure 5:
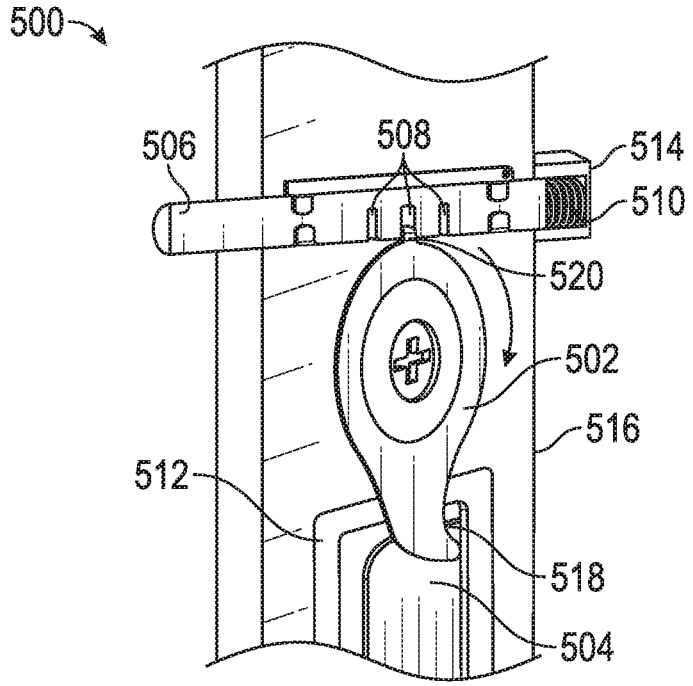
FIG. 5 is a perspective view showing an example of an embodiment of a door silencing mechanism, according to an embodiment.

FIG. 5 illustrates a single door silencing mechanism 500 being mounted on a door. Multiple door silencing mechanisms 500 can be installed to retain the spring latch bolt 504 within the housing 512. Multiple door silencing mechanisms can provide less stress on each actuator 502, thereby allowing a smaller or a slimmer actuator 502 to be used. Multiple door silencing mechanisms can also improve functionality and allow for slimmer hardware.

As further illustrated in FIG. 5, the extension component 506, for example, extends the contact point of the actuator 502 and makes contact with the door jamb. This embodiment eliminates the use of a contact component 108 as illustrated in FIG. 1. In one embodiment, the extension component 506 is coupled to the actuator 502 via a series of linkage connections 508 and contacts with door stop edge before the door face can make contact with the door stop edge. The linkage connections 508 are for an adjustable lever extension for varying door depths and door gap adjustment. Upon contact, the actuator 502 can be moved to a second position via the series of linkage connections 508 and release the spring latch bolt 504 from within the bolt housing 512 by moving the second end 518 of the actuator 502 in response to contact with a door jamb. The extension component 506 would be the input of force at a contact component 520 which would turn the second end 518 of the actuator when contact is made against the door jamb stop at that final moment of door closure.

In an embodiment, a compression spring 510 is used to maintain the actuator 502 in a first position. In one embodiment, the compression spring 510 is housed within a spring housing 514 and the spring housing 514 is connected to a mounting plate 516. This embodiment can work with an adjustable strike plate 134, 416 as shown in FIG. 1 and FIG. 4, but without the requirement of contact points 136 or 414. The adjustable strike plate allows for the adjustment of the contact tab position to ensure that the spring latch bolt 114 extends immediately after passing its retaining edge or "tab". Further, the adjustability of the strike plate allows for the adding damper pads on the jamb stop and varying distance or space between the door latch bolts and the jamb stop.

In some embodiments, a compression spring 510 within a spring housing connected to the mounting plate extended over the door face opposite the jamb stop contact face makes contact and keeps constant pressure against the lever extension arm.

Returning to FIG. 2, in one embodiment, a door status indicator 222 is installed on or attached to a spring housing 226. The door status indicator 222 can indicate the door is properly latched when the extension component 202 makes contact with a button positioned in the spring housing 226. The door status indicator 222 can make a sound or light up. In one embodiment, the door status indicator 222 also is as simple as an extension rod that extends from the extension component 202 through an opening in the spring housing 226 to appear when the door is fully latched.

Figure 6:
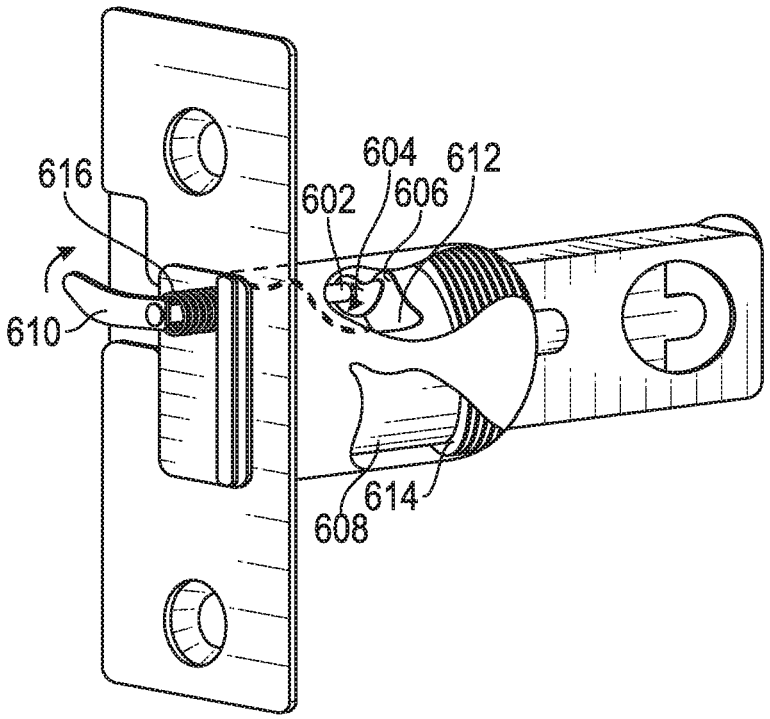
FIG. 6 is a perspective view of another example of a door silencing mechanism, according to an embodiment.

In another embodiment, a door silencing mechanism is integrated in a spring latch bolt or a dead latch. As illustrated in FIG. 6, this embodiment can benefit from being coupled with an adjustable strike plate alternative. By way of an extension rod 602, in one embodiment, an actuator 604 within the latch housing rests upon a flat surface 606 of a lower portion of the latch bolt 608. In one embodiment, the actuator 604 can be extended to the latch plate surface where the actuator 604 is connected to an actuator contact 610. The actuator contacts 610 is used to make contact with a surface point on the door jamb such as the jamb stop.

As illustrated in FIG. 6, in one embodiment, a spring 616 is used to maintain the actuator 604 in a first position such that the latch bolt 608 is secured within the housing. When the actuator contact makes contact with the door jamb, the actuator 604 moves the extension rod 602 from the flat surface 606, through a curved slope 612, therefore releasing the latch bolt 608 from within the housing. In one embodiment, the extension rod 602 is connected to the spring bolt 614 by using chamfered gears that can push and pull the latch bolt 608.

Figure 7:
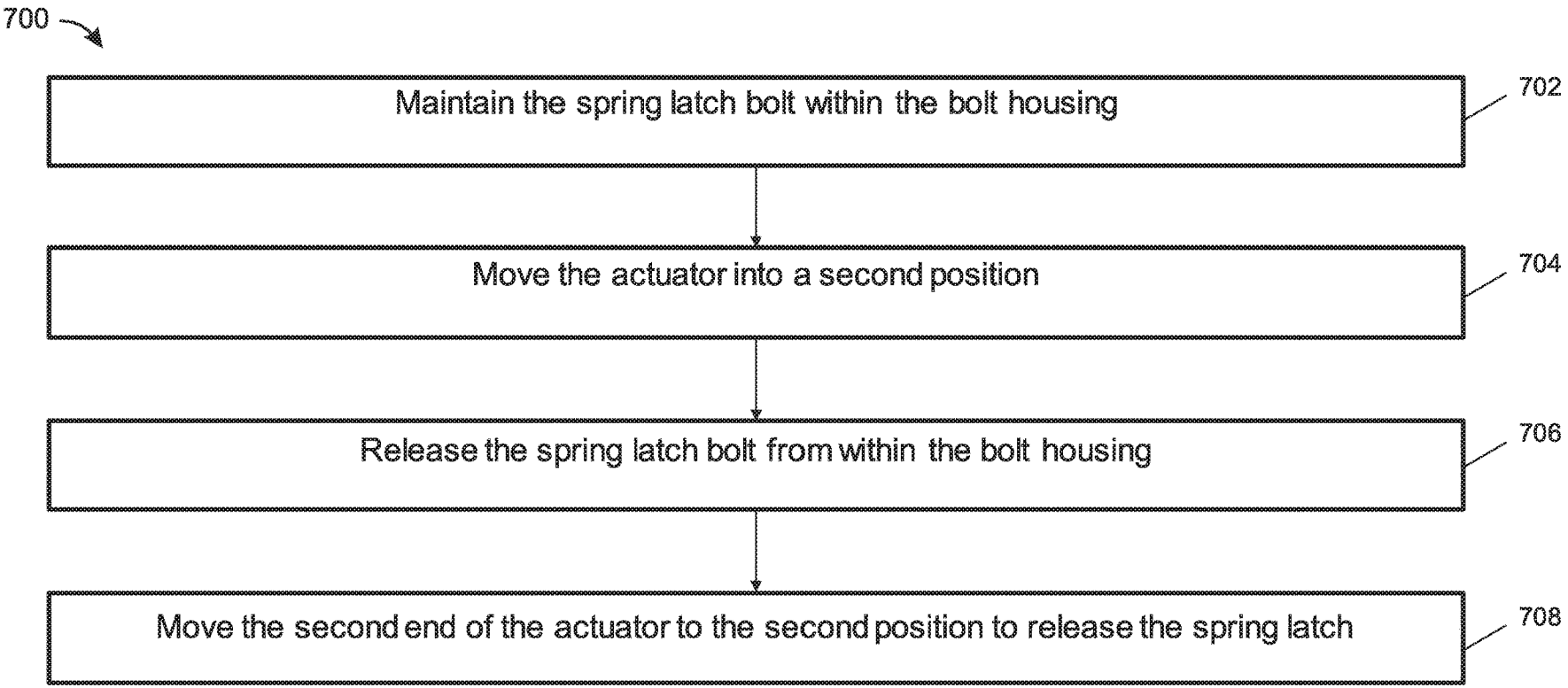
FIG. 7 is a flow chart which illustrates a method for operating a door silencing mechanism, according to an embodiment.

The present disclosure is also directed to a method 700 to operate a door silencing mechanism 100 to eliminate latch noise associated with a door latch having a spring latch bolt 114 and a bolt housing 122, as illustrated in FIG. 7. In some embodiments, for example, the method 700 includes an operation 702 of maintaining the spring latch bolt 114 within the bolt housing 122 using a second end 106 of an actuator 102 when the actuator 102 is in a first position 116 to avoid contact between the spring latch bolt and a strike plate associated with a doorjamb.

In this manner, the latch bolt 114 is maintained below the door surface and within the latch assembly housing 122 until the time the door is fully, or near fully shut, thereby eliminating the immediate contact between the latch bolt 114 and strike plate or other latch retaining hardware. Embodiments of the door silencing mechanism and method also restricts the spring bolt 114 from sudden, unimpeded spring extension which occurs when a spring latch bolt 114 passes beyond the "tab" of the latch hole opening at the final moment of a door closure. The spring latch bolt 114 would be held low with respect to the latch plate surface and this position represents a default position 116 for the spring latch bolt.

The mechanism restricts the latch bolt 114 to a gradual extension using the force of the closing door to turn the restricting element of the mechanism, thereby eliminating the typical "popping" sound heard at the final moment of door closure. As illustrated in FIG. 7 the method also includes an operation 704 of moving the actuator 102 into a second position 118 in response to the actuator 102 contacting a door jamb 130. The default position creates a clearance between the spring latch bolt 114 and the passing surface of the strike plate or alternate latching surface until actuator 102 is employed to activate the spring latch bolt 114 to be released in a controlled motion at a precise moment when the tip of the spring latch bolt 114 is positioned just past the latch opening cliff or an alternate latch bolt mate while allowing for the hardware originally intended full ability to latch and lock.

In some embodiments, for example, the method can further include an operation 706 of releasing the spring latch bolt 114 from within the bolt housing 122 by moving the second end 106 of the actuator 102 in response to the actuator 102 moving to the second position 118. In one embodiment, the spring latch bolt is released when the spring latch bolt passes beyond a tab associated with a bolt retainer associated with the doorjamb. In this manner, the latch bolt 114 is retracted until the latch bolt 114 is aligned with the latch opening 138 associated with the door or positioned over the latch opening at door. The latch bolt 114 will be released in a controlled motion using the embodiments of the door silencing mechanism when the latch bolt 114 is positioned over the latch hole at door. Withholding the latch until the latch bolt 114 is positioned over the latch opening 138 at door results in less contact with the hardware, thereby eliminating the contact noise when the standard latch throw would typically slap against the metal strike plate during closure of the door.

In another embodiment, the spring latch bolt 212 can be released from within the bolt housing 228 in response to a contact component 202 contacting the door jamb 216.

As further illustrated in FIG. 7 the method also includes an operation 708 of moving the second end 208 of the actuator 204 to the second position 210 to release the spring latch bolt 212 from within the bolt housing 228 in response to an extension component 202 coupled to the first end 220 of the actuator 204 contacting with the door jamb 216, such that the spring latch bolt is positioned behind a tab edge associated with the strike plate.

Figure 8B:
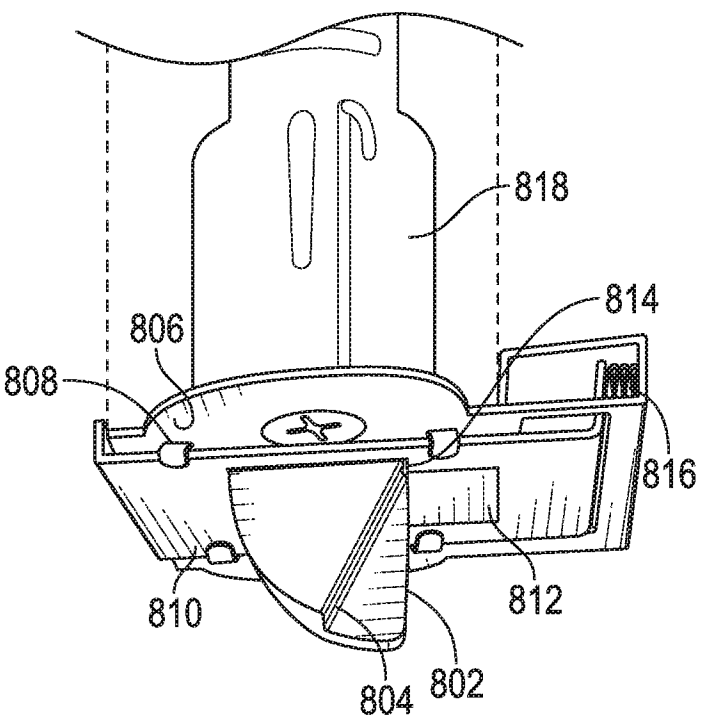
FIG. 8B is a perspective view showing an example of an embodiment of a door silencing mechanism at a second position, according to an embodiment.
Figure 8A:
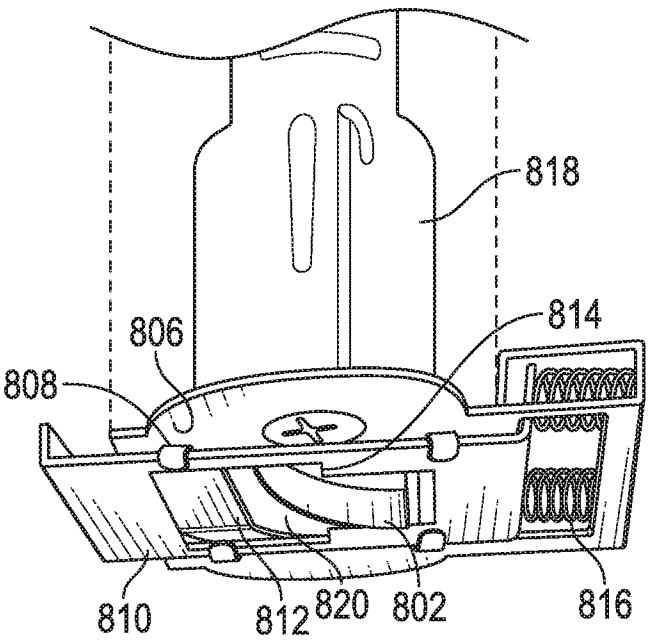
FIG. 8A is a perspective view showing an example of an embodiment of a door silencing mechanism at a first position, according to an embodiment.

FIGS. 8A and 8B show an embodiment of a door silencing mechanism to eliminate latch noise associated with a door latch having a spring latch bolt and a bolt housing. The mechanism includes a sliding component 810 coupled to a backing plate 806 to guide the sliding component 810 to move from a first position to a second position. FIG. 8A shows the embodiment is in a first position and FIG. 8B shows the embodiment is in a second position. The sliding component 810 is coupled to the backing plate 806 via a plate retainer 808. In some embodiments, the sliding component 810 maintains the spring latch bolt 802 within a bolt housing 818 when the sliding component 810 is in the first position and to release the spring latch bolt 802 from within the bolt housing 818 when the sliding component 810 is in the second position in response to contact with a doorjamb. The bolt housing 818 includes an inner portion 820 of a cylinder portion of the bolt housing 818 through which the spring latch bolt 802 stays retracted when the sliding component 810 is in the first position and extends when the sliding component 810 is in the second position. The inner portion 820 of the cylinder portion of the bolt housing 818 is visible when the sliding component 810 is in the first position.

In some embodiments, the spring latch bolt 802 surface includes a groove(s) 804 to guide the spring latch bolt 802 from the first position to the second position. The grooves 804 are positioned at an inverse angle to that of the standard spring latch bolt's curved face used in the other methods described previously as the actuator contact. This reversal of the bolt contact points allows for actuator hardware to move in the opposite direction to the aforementioned methods. This reversal of direction can be advantageous, as the actuator or sliding component does not need to reverse its direction to accommodate the curved latch face, which requires the use of hinges or a multitude of gears to reverse. Rather, the bolt control hardware or actuator can move directly with the force of contact with the jamb. In one embodiment, the sliding component includes a protrusion 814 that acts to hold the spring latch bolt 802 within the bolt housing 818 when the sliding component 810 is in the first position and extends into the groove 804 as the spring latch bolt 802 is released gradually as the sliding component 810 is being moved across the deeper recesses of the grooves from the first position to the second position.

In one embodiment, the backing plate 806 includes a slot 822 to stop the sliding component 810 when the sliding component 810 is in the second position in response to contact with the door jamb.

In some embodiments, the mechanism also includes one or more compression springs 816 coupled to the sliding component 810 to maintain the sliding component 810 in the first position when the sliding component 810 is not in contact with the doorjamb.

In one embodiment, the sliding component includes an opening 812. The opening includes a protrusion 814 that acts to hold the spring latch bolt 802 within the bolt housing 818 when the sliding component 810 is in the first position and extends into the groove 804 as the spring latch bolt 802 is released gradually as the sliding component 810 is being moved across the deeper recesses of the grooves from the first position to the second position.

In some embodiments, the sliding component 810 maintains the spring latch bolt 802 within a bolt housing 818 when the sliding component 810 is in the first position and to release the spring latch bolt 802 from within the bolt housing 818 through the opening 812 when the sliding component 810 is in the second position in response to contact with a door jamb.

Figure 9B:
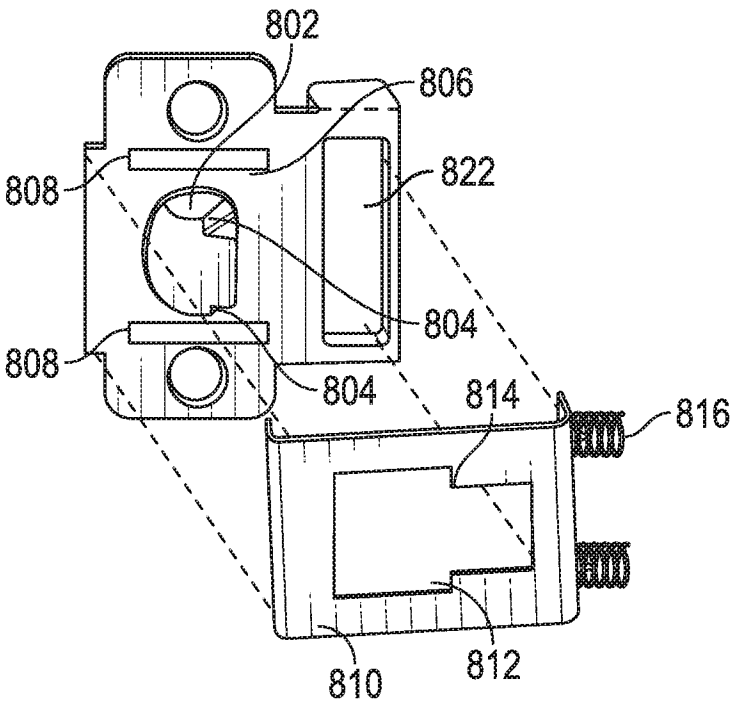
FIG. 9B is an exploded view showing an example of an embodiment of a door silencing mechanism, according to an embodiment.
Figure 9A:
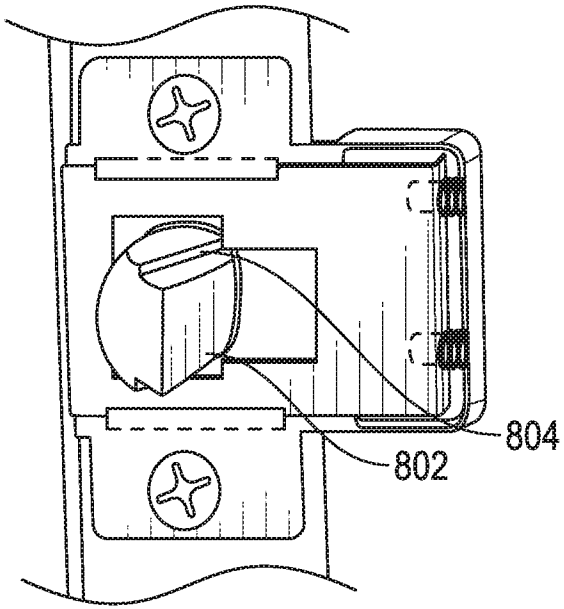
FIG. 9A is a front elevation view showing an example of an embodiment of a door silencing mechanism at a second position, according to an embodiment.

FIG. 9A shows an embodiment of a door silencing mechanism in a second position. In one embodiment, the spring latch bolt 802 surface includes a groove(s) 804 to guide the spring latch bolt 802 from the first position to the second position.

FIG. 9B is an exploded view of the embodiment of a door silencing mechanism.

In an embodiment, the mechanism includes a sliding component 810 having an opening 812 coupled to the backing plate 806 to guide the sliding component 810 to move from a first position to a second position. The sliding component 810 is coupled to the backing plate 806 via a plate retainer 808. In some embodiments, the sliding component 810 maintains the spring latch bolt 802 within a bolt housing 818 when the sliding component 810 is in the first position and to release the spring latch bolt 802 from within the bolt housing 818 through the opening 812 when the sliding component 810 is in the second position in response to contact with a door jamb. The mechanism also includes one or more compression springs 816 coupled to the sliding component 810 to maintain the sliding component 810 in the first position when the sliding component 810 is not in contact with the door jamb. In one embodiment, the backing plate 810 includes a slot 822 to stop the sliding component 810 when the sliding component 810 is in the second position in response to contact with the door jamb.

Decibel Level Testing

Testing noise output with a decibel meter 7 feet away from a door being closed. The bedroom ambient noise, or base noise (without door noise) is 63 db. This would be perceived as a quiet room by most standards. Each result shown is averaged out of 3 tests at equal closing force, and the results in each category never differed more than 3 Decibels. This is a standard interior door of a bathroom as heard from a bed in the adjoining room 7 feet away. The "closed lightly" category was not a slow close, but rather one that was pushed with enough force and speed to definitely latch but not much excess; what many would view as a normal door closure.

No dampers or latch control actuator: Closed lightly: 84 db; Forceful shut or slam: 95 db With felt pads on jamb: Closed lightly: 81 db; Forceful shut or slam: 93 db With latch control actuator: Closed lightly: 72 db; Forceful shut or slam: 88 db With both adhesive felt pad dampers and control actuator: Closed lightly: 67 db; Forceful shut or slam: 76 db.

In the case of the lightly shut door using both jamb padding and a Latch Bolt Control Device, the 4 Decibel increase from the base level of ambient noise created in this setting is hardly discernible by the human ear, even when focusing on the noise while watching the door action it is truly perceived as being silent.

The present application is a non-provisional application which claims priority to, and the benefit of U.S. Provisional Application No. 62/842,541, titled "Door spring latch silencing attachment device and method for quieting latch noise by managing a spring latch bolt," filed May 3, 2019, which is incorporated herein by reference in its entirety.

In the foregoing specification, specific exemplary embodiments have been described. It should be understood that the order of activity as depicted in the figures above are conceptual and may deviate without departing from the various embodiments disclosed. Moreover, the specification and drawings are, accordingly, to be regarded in an illustrative rather than a restrictive sense. It will, however, be evident that various modifications and changes may be made thereunto without departing from the broader spirit and scope of the disclosure. While different embodiments of the disclosure, including apparatuses, systems, and methods, have been shown or described in only some of its forms, it should be apparent to those skilled in the art that the disclosure is not so limited, but is susceptible to various changes without departing from the scope of the disclosure. Furthermore, it is to be understood that the above disclosed embodiments are merely illustrative of the principles and applications of the present disclosure. Accordingly, numerous modifications may be made to the illustrative embodiments and other arrangements may be devised without departing from the spirit and scope of the present disclosure.

What is claimed is:

1. A door silencing mechanism to eliminate latch noise associated with a door latch having a spring latch bolt and a bolt housing, the mechanism comprising:

an actuator having a first end and a second end and moveable between a first position and a second position; and a device coupled to the first end of the actuator to maintain the spring latch bolt within the bolt housing using the second end of the actuator when the device holds the actuator in the first position and to release the spring latch bolt from within the bolt housing by moving the second end of the actuator in response to the actuator moving to the second position in response to contact with a doorjamb, wherein the actuator covers the spring latch bolt to maintain the spring latch bolt within the bolt housing when the actuator is in the first position, and the actuator uncovers the spring latch bolt to release the spring latch bolt from within the bolt housing when the actuator is in the second position, and wherein the actuator rotates about an axis parallel to an axis of spring latch bolt movement.

2. The door silencing mechanism of claim 1, wherein when the actuator is in the second position, the spring latch bolt is aligned with a bolt retainer and allowed to be received by the bolt retainer positioned at a door jamb main body.

3. The door silencing mechanism of claim 1, wherein the device comprises a spring.

4. The door silencing mechanism of claim 1, wherein the device further comprises a contact component to cause the spring latch bolt to be released from within the bolt housing in response to contact with the doorjamb.

5. The door silencing mechanism of claim 1, wherein the first end of the actuator is coupled to an extension component to extend a contact point associated with the first end, such that the extended contact point makes contact with the door jamb during a door closure.

6. The door silencing mechanism of claim 1, wherein the first end of the actuator is coupled to an extension component to maintain the actuator in the first position, the extension component causing the second end of the actuator to move to the second position and to release the spring latch bolt from within the bolt housing in response to contact with the doorjamb.

7. The door silencing mechanism of claim 6, wherein the extension component comprises a door status indicator indicating the spring latch bolt has been received by a bolt retainer.

8. The door silencing mechanism of claim 1, wherein the device further comprises a stopping component being positioned on a backing plate of the door latch to maintain the actuator in the first position.

9. The door silencing mechanism of claim 8, wherein the device further comprises an attachment component being positioned on the backing plate of the door latch to secure the actuator to the backing plate of the door latch.

10. The door silencing mechanism of claim 1, wherein the actuator has an S shape.

11. The door silencing mechanism of claim 1, wherein the second end of the actuator is maintained in the first position by an elastic component.

12. The door silencing mechanism of claim 1, the actuator having a shape and being dimensioned to fit a space between the door latch and the door jamb.

13. The door silencing mechanism of claim 1, wherein the second end of the actuator is maintained in the first position to contact a top portion and a bottom portion of the spring latch bolt.

14. A method to operate a door silencing mechanism to eliminate latch noise associated with a door latch having a spring latch bolt and a bolt housing, the method comprising:

maintaining the spring latch bolt within the bolt housing using a second end of an actuator when the actuator is in a first position, wherein maintaining the spring latch bolt within the bolt housing comprises covering the spring latch bolt by using the second end of the actuator when the actuator is in the first position;

moving the actuator into a second position in response to the actuator contacting a door jamb; and releasing the spring latch bolt from within the bolt housing by moving the second end of the actuator in response to the actuator moving to the second position, wherein releasing the spring latch bolt from within the bolt housing comprises uncovering the spring latch bolt by moving the second end of the actuator in response to the actuator moving to the second position, and wherein the actuator rotates about an axis parallel to an axis of spring latch bolt movement.

15. The method of claim 14, wherein the spring latch bolt is released when the spring latch bolt passes beyond a bolt retainer associated with the doorjamb.

16. The method of claim 14, the method further comprising:

releasing the spring latch bolt from within the bolt housing in response to a contact component contacting the door jamb.

17. The method of claim 14, the method further comprising:

moving the second end of the actuator to the second position to release the spring latch bolt from within the bolt housing in response to an extension component coupled to a first end of the actuator contacting with the door jamb, such that the spring latch bolt is positioned behind a tab edge associated with a strike plate.

18. The method of claim 17, wherein the extension component comprises a door status indicator indicating the spring latch bolt has been received by a bolt retainer.

19. A door silencing mechanism to eliminate latch noise associated with a door latch having a spring latch bolt and a bolt housing, the mechanism comprising:

a sliding component coupled to a backing plate to guide the sliding component to translate linearly from a first position to a second position, the sliding component to maintain the spring latch bolt within the bolt housing when the sliding component is in the first position and to release the spring latch bolt from within the bolt housing when the sliding component is in the second position in response to contact with a doorjamb, wherein the sliding component covers the spring latch bolt to maintain the spring latch bolt within the bolt housing when the sliding component is in the first position, and the sliding component uncovers the spring latch bolt to release the spring latch bolt from within the bolt housing when the sliding component is in the second position, and wherein movement of the sliding component is perpendicular to movement of the spring latch bolt.

20. The door silencing mechanism of claim 19, wherein the spring latch bolt surface having a groove to guide the spring latch bolt from the first position to the second position, the sliding component having a protrusion that acts to hold the spring latch bolt within the bolt housing when the sliding component is in the first position and extends into the groove of the spring latch bolt as the spring latch bolt is released when the sliding component is being moved from the first position to the second position.

21. The door silencing mechanism of claim 19, wherein the backing plate includes a slot to stop the sliding component when the sliding component is in the second position in response to contact with the door jamb.

22. The door silencing mechanism of claim 19 further comprising one or more compression springs coupled to the sliding component to maintain the sliding component in the first position when the sliding component is not in contact with the doorjamb.

23. The door silencing mechanism of claim 20, wherein the sliding component includes an opening.

* * * * *